United States Patent [19]

Hill et al.

[11] Patent Number: 4,922,302

[45] Date of Patent: May 1, 1990

[54] DEVICE FOR DEVELOPING ELECTROSTATIC IMAGES ON A FILM BELT

[75] Inventors: Lawrence A. Hill, Rochester; Michael E. Jacobs, Henrietta; Arthur S. Kroll, Brighton; Ralph E. Williams, Rochester, all of N.Y.

[73] Assignee: Eastman Kodak Company, Rochester, N.Y.

[21] Appl. No.: 216,671

[22] Filed: Jul. 7, 1988

[51] Int. Cl.[5] ..... G03G 15/08; G03G 15/09

[52] U.S. Cl. ..... 355/251; 355/212; 355/244; 355/260

[58] Field of Search ..... 355/15, 3 BE, 3 DD, 355/212, 251, 260, 244; 354/318; 29/119, 118, 132, 115, 123; 118/661

[56] References Cited

U.S. PATENT DOCUMENTS

| | | | |
|---|---|---|---|
| 3,256,855 | 6/1966 | Oliphant | 118/661 X |
| 4,264,182 | 4/1981 | Mitchell | 355/3 DD |
| 4,361,112 | 11/1982 | DiNallo, Sr. et al. | 118/661 |
| 4,657,370 | 4/1987 | Forbes, II et al. | 355/315 X |
| 4,797,704 | 1/1989 | Williams et al. | 355/3 DD |
| 4,803,511 | 2/1989 | Izzo | 355/3 BE X |
| 4,804,993 | 2/1989 | Kenin et al. | 355/3 BE |

*Primary Examiner*—A. C. Prescott
*Assistant Examiner*—B. Shapiro
*Attorney, Agent, or Firm*—Leonard W. Treash

[57] ABSTRACT

A device for developing electrostatic images carried on a film belt in an apparatus receiving the developing device includes device location surfaces which seat on apparatus location surfaces in the apparatus to locate the device with respect to the apparatus. Film support surfaces on the device support the film belt a fixed spacing from a developer applicator. The film support surfaces are located within tight tolerances with respect to the surface of the applicator to provide accurate positioning of the applicator and film belt.

10 Claims, 5 Drawing Sheets

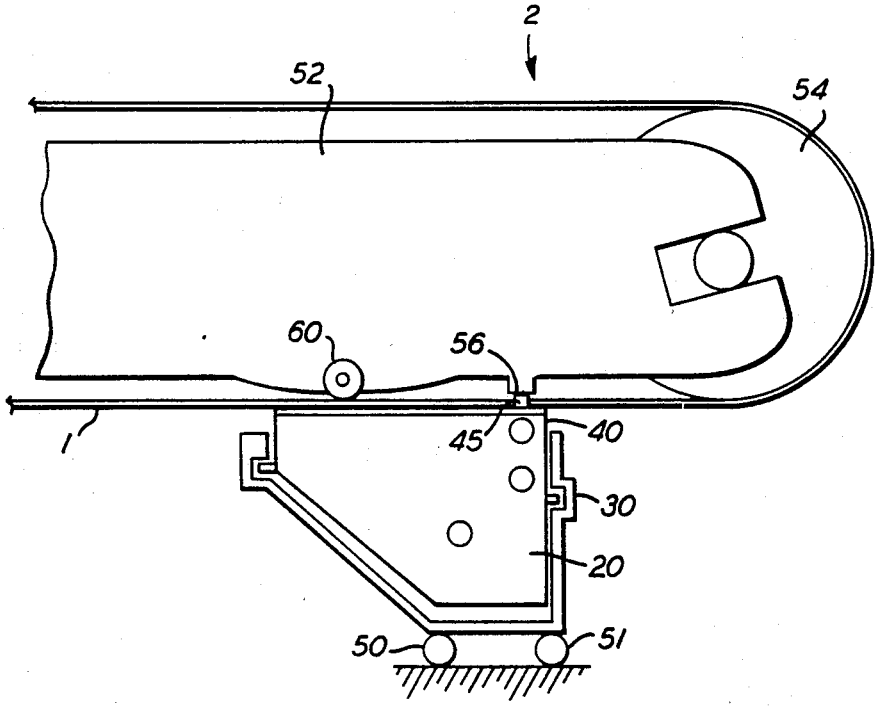
FIG. 4
FIG. 5
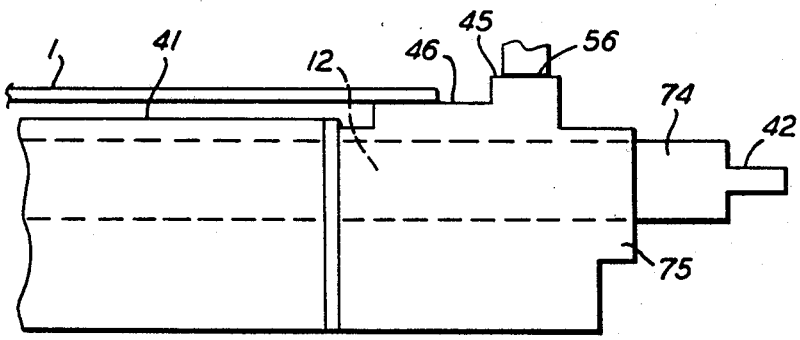

DEVICE FOR DEVELOPING ELECTROSTATIC IMAGES ON A FILM BELT

TECHNICAL FIELD

This invention relates to a device for developing electrostatic images, and more particularly, to a mechanism for controlling the interface between a moving film belt carrying an electrostatic image and the developing device.

Background Art

U.S. patent applications No. 116,200 now U.S. Pat. No. 4,797,704 and 116,294 now abandoned both filed by L. A. Hill and M. E. Jacobs on Nov. 3, 1987 disclose a disposable device for developing electrostatic images. U.S. patent application No. 81,764 filed by Kenin et al in Dec. 1987, now U.S. Pat. No. 4,804,993 discloses. apparatus intended to receive a disposable development device generally of the type shown in the Hill et al applications. The apparatus is of the "clamshell" type, with an upper section which pivots upward away from a lower section for servicing. The developing device is slid endwise into place in the lower section. An endless film belt having photoconductive properties is mounted in the upper section and is lowered into developing relation with the developing device and other electrophotographic stations.

Some developing systems, including those shown in the applications referred to require fairly accurate spacing between an application means in the developing device and the film belt for best toner images. Further, the belt and development device, being consumable parts of the system and located in upper and lower sections, respectively, are difficult to maintain in correct location and orientation with respect to each other when the apparatus is in its operational mode.

Disclosure of the Invention

It is the object of the invention to provide a disposable development device and a belt type apparatus for receiving it in which accuracy in location of the belt and the device with respect to each other is readily obtained.

It is another object of this invention to provide such accuracy with a structure simple enough that the development device can economically be made disposable.

These and other objects are accomplished by a disposable development device cooperable with apparatus supporting a film belt which apparatus includes apparatus location surfaces located on opposite edges of a path through which the belt moves. The device includes device location surfaces which are contactable by the apparatus location surfaces. Film support surfaces, preferably adjacent the device location surfaces, are fixed with respect thereto and support the film in a predetermined location with respect to the development device. The device further includes a developer application means having a location fixed with respect to the film support surface to provide a proper interface with the film belt for developing electrostatic images carried by the film belt.

According to a preferred embodiment of the invention, the application means, the film support surface and the device location surfaces are all part of a single unitary component, which can be made to relatively tight tolerances and performance of which does not tend to be affected by overall assembly of the device.

According to another preferred embodiment the film support surfaces are recessed from the device location surfaces which forms a channel assisting in edge guiding the film.

It is also an aspect of the invention to provide apparatus for receiving such a device and cooperating with it to assure proper location thereof.

With the invention, proper location between the developing device and the apparatus receiving it can be maintained despite the fact that the structures are supported by different sections of the apparatus, despite the fact that the development device is continually replaceable in the apparatus, and without imposing substantial manufacturing cost on the system, especially the disposable development device.

BRIEF DESCRIPTION OF THE DRAWINGS

FIG. 4 is a side schematic view of a film belt component and developing device constructed according to the invention.

FIG. 5 is an end view of the film belt component and development device shown in FIG. 4.

Best Mode of carrying out the Invention

Figure 3:
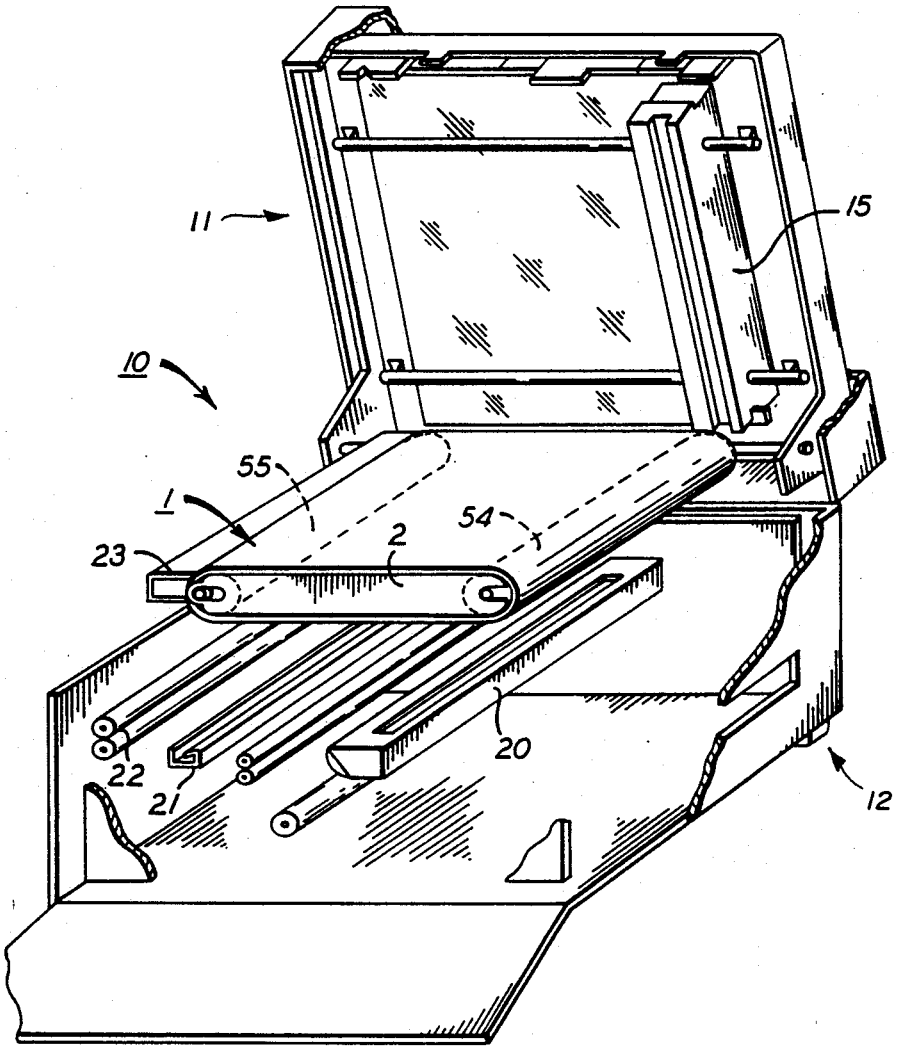
FIG. 3 is a perspective view of an apparatus for receiving the device of FIG. 1, with portions eliminated for clarity.

According to FIG. 3, an electrophotographic apparatus 10, for example, a printer or copier, includes an upper section 11 and a lower section 12 which are openable as shown. Upper section 11 includes a film belt 1, which is part of a film belt assembly 2. The film belt is movable through a path taking it past a series of electrophotographic stations only some of which are shown in the drawings. Briefly, the belt is uniformly charged and exposed by an exposure head 15 to create an electrostatic image. The electrostatic image is developed at a development station 20 which will be discussed in more detail with respect to the other FIGS. The resulting toner image is transferred to a receiving sheet at a transfer station 21, and the transferred image is fused by a fuser 22. The belt 1 is cleaned at a cleaning station 23, and the process is repeated for more images, all as is well known in the art.

As can be seen in FIG. 3, the belt assembly 2 can be pivoted to a lowered position from the upper section 11 for replacing the film belt 1. When that function is not being performed, the film belt assembly 2 is firmly attached to the upper section 11 in operative relation with the exposure head 15. When the upper section 11 is lowered into place with the lower section 12, the film belt assembly assumes an operative relation with the development station and other stations in the lower section.

Some development systems give quite high quality results, but require fairly close spacing tolerances between the developing device and the electrostatic image. For example, certain magnetic brush systems require that a slight space be maintained between an applicator and the image for best quality images. That space may, in operation, be filled or partly filled by developer forming bristles on the applicator surface. The ability to maintain such a spacing without expensive structure and quality control can determine whether the system can be feasible for a low cost printer or copier. The apparatus shown in FIG. 3 is a low cost printer or copier which adds further to the challenge by having a customer replaceable development device, by using a belt imaging member instead of a drum and by putting the belt in a section separatable from the developing device.

Figure 1:
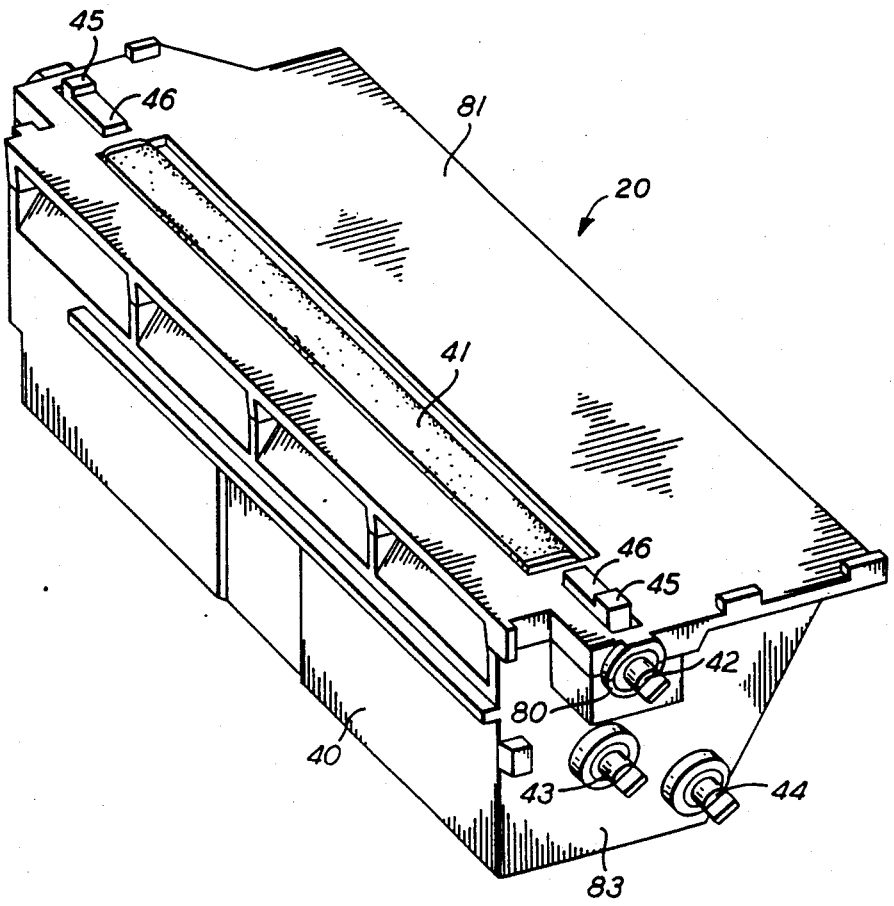
FIG. 1 is a perspective view of a disposable development device constructed according to the invention.

The development device 20 is best seen in FIG. 1. It has a disposable plastic housing 40, an applicator 41, an applicator drive coupling 42 and two other drive couplings 43 and 44. Device locating surfaces 45 and film support surfaces 46 protrude through a cover 81 on housing 40.

The mechanism used to control spacing between the film belt and the development device is best seen in FIGS. 4 and 5. According to FIG. 4, the development device 20 is inserted endwise into a receiving channel 30 which is a permanent part of the apparatus. The receiving channel is nested on structure most of which is not shown but which includes resilient foam pads 50 and 51. Removal of the device is aided by a handle 90, shown in FIG. 6.

The film belt assembly 2 includes belt assembly frame members 52 at opposite edges of the film belt 1. The frame members support two rollers 54 and 55 (FIG. 3). The frame members also form apparatus locating surfaces 56. When the upper section is lowered into operative position with the lower section, the apparatus locating surfaces 56 seat on the device locating surfaces 45. The surfaces are assisted in seating by pads 50 and 51 which are resiliently compressible allowing the developing device 20 to assume a position dependent on the position of the film belt assembly 2, more particularly, apparatus location surfaces 56.

As best seen in FIG. 5, film belt 1 is supported by film support surfaces 46 at each edge of the belt. Preferably the film support surfaces are recessed from the device location surfaces forming a channel for the film belt which assists in edge guiding the belt. To assure contact between the film support surfaces and the film belt, a film bar 60 engages the film belt 1 at a location downstream from the apparatus location surfaces 56 (see FIG. 4). The film bar 60 is mounted between frame members 52 and intersects the path of film 1 urging it down, as shown in FIG. 4, thereby assuring contact between the film and film support surfaces 46.

Figure 2:
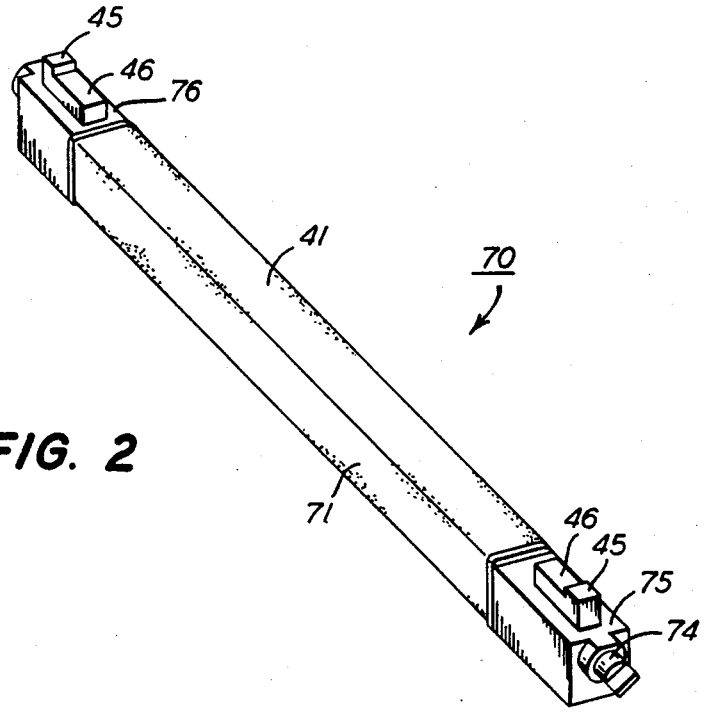
FIG. 2 is a perspective view of a unitary applicator component shown in FIG. 1.
Figure 7:
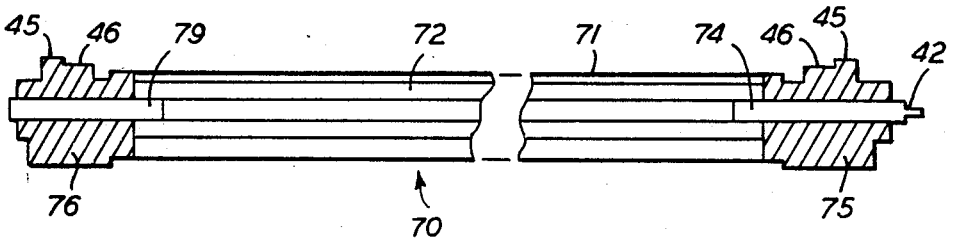
FIGS. 7 and 8 are side and end cross sections of the component shown in FIG. 2 with some parts eliminated for clarity.
Figure 8:
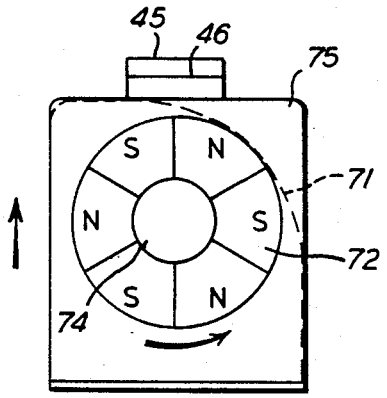

The film being relatively stiff, little sagging is experienced across, for example, a 25 centimeter width. Thus, the location of the electrostatic image bearing surface of the film 1 is established with respect to the film support surfaces 46. To assure proper spacing for the development process, the surface of the applicator 41 must be fixed within relatively tight tolerances with respect to surfaces 46. This is accomplished by manufacturing the applicator 41 and the surfaces 46 into a single applicator component 70, best seen in FIGS. 2, 7 and 8. Component 70 includes a nonmagnetic sleeve 71 which surrounds a hollow rotatable magnetic pole piece 72 (FIG. 5). A plastic drive bearing-coupling 74 is inserted in one end of a bore in the pole piece 72 and a similar plastic bearing 79 is inserted in the opposite end of the pole piece 72. Bearing 74 has drive coupling 42 molded its outer end. Surfaces 45 and 46 are molded into plastic end pieces 75 and 76 which are inserted as plugs into opposite ends of sleeve 71. Drive coupling 42 mates with a suitable drive, not shown, in the receiving apparatus. It is rotated at high speed, rotating the pole piece and driving hard magnetic carrier particles in a direction around the sleeve 71 opposite to the rotation of the pole piece 72, as shown by the arrows in FIG. 8. This particular type of structure is more completely described in the Hill et al applications cited above.

Figure 6:
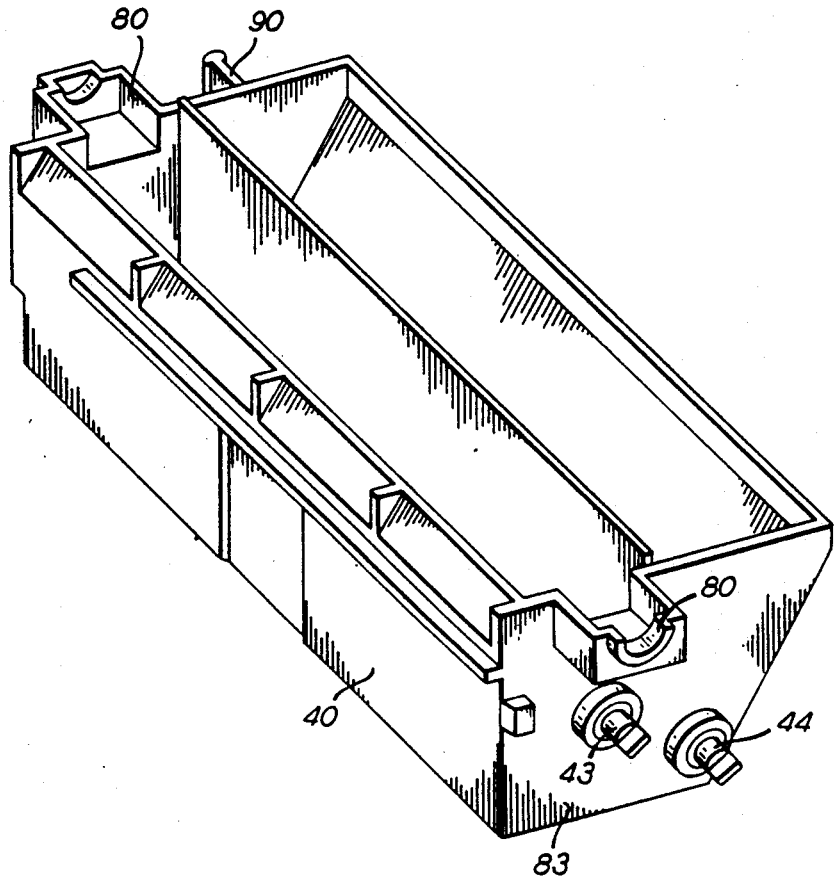
FIG. 6 is a perspective view similar to FIG. 1 but with a cover and applicator component removed from the development device.

Once component 70 is manufactured to tight tolerances, at least with respect to the location of the surface of applicator 41 and film support surfaces 46, its assembly in the rest of the developing device 20 does not require the holding of such tight tolerances. As best seen in FIG. 6, component 70 fits snugly into cavities 80 defined by housing 40 of the development device 20. After component 70 has been seated, the cover 81 is placed on top of the device 20. As seen in FIG. 1, cover 81 has apertures through which surfaces 45 and 46 and applicator 41 protrude.

With this invention, the film belt and the applicator can be held in accurate spacing, which spacing may be partly or entirely filled with developer. That spacing is established with a structure simple enough to be economically disposable.

The invention has been described in detail with particular reference to preferred embodiments thereof, but it will be understood that variations and modifications can be effected within the spirit and scope of the invention.

We claim:

1. A device for developing electrostatic images, which device is usable in apparatus of the type in which a film belt carrying an electrostatic image moves through a path past said device, the apparatus including a film belt assembly including at least two rollers for supporting the belt in the path and frame members on opposite edges of the path for supporting the rollers, each frame member including an apparatus location surface, said device comprising:

device location surfaces adjacent opposite edges of the path for engaging the apparatus location surfaces of a film belt assembly when in operative relation therewith, to control the location of the device with respect to the assembly, film support surfaces adjacent opposite edges of the path for engaging opposite edges of a film belt forming part of the assembly, and for supporting the film belt in a fixed location with respect to said device, and developer application means located generally between said film support surfaces and having an applicator surface facing said path and in operative relation with said path which applicator surface is fixed in location with respect to said film support surfaces and therefor fixed with respect to the film belt.

2. The device according to claim 1 wherein said applicator surface is recessed from the path compared to said film support surfaces to provide a spacing between the applicator surface and a film belt in the path.

3. The device according to claim 1 wherein said device location, surfaces are located outwardly from said film support surfaces with respect to the path.

4. The device according to claim 3 wherein said device location surfaces are raised with respect to the film support surfaces to form a channel for a film belt in the path.

5. The device according to claim 1 wherein said developer application means, said film support surfaces and said device location surfaces are all contained in a single unitary component in said device.

6. The device according to claim 5 wherein said unitary component includes an elongated tubular sleeve surrounding a rotatable magnetic pole piece, said sleeve having plastic endpieces inserted in the opposite ends thereof which endpieces have said film support surfaces and device location surfaces molded therein.

7. The device according to claim 5 wherein said unitary component is nested in an upper part of said device, and said device includes a cover which includes apertures through which said developer application means, said film support surfaces and said device location surfaces protrude.

8. A unitary component usable in a device for developing electrostatic images, which device is usable in apparatus of the type in which a film belt carrying an electrostatic image moves through a path past said device, the apparatus including a film belt assembly including at least two rollers for supporting the belt in the path and frame members on opposite edges of the path for supporting the rollers, each frame member including an apparatus location surface, said unitary component comprising:

device location surfaces for engaging the apparatus location surfaces of a film belt assembly when in operative relation therewith, to control the location of the component with respect to the assembly, film support surfaces for engaging opposite edges of a film belt forming part of the assembly, and for supporting the film belt in a fixed location with respect to said component, and developer application means located generally between said film support surfaces which applicator surface is fixed in location with respect to said film support surfaces.

9. A unitary component usable in a device for developing electrostatic images, which device is usable in apparatus of the type in which a film belt carrying an electrostatic images moves through a path past said device, the apparatus including a film belt support structure including at least two rollers for supporting the belt in the path and frame members on opposite edges of the path which frame members are fixed with respect to the rollers, each frame member including an apparatus location surface, said unitary component comprising:

a single tubular shaped developer applicator;

an end piece fixed to each end of said applicator;

means on each of said end pieces defining device location surfaces for engaging the apparatus location surfaces of a film belt support structure when in operative relation therewith, to control the location of the component with respect to the support structure.

10. A unitary component according to claim 9 further including film support surfaces integrally molded with said device location surfaces into said end pieces for engaging opposite edges of a film belt forming part of the apparatus for supporting the film belt in a fixed location with respect to said applicator.

* * * * *